United States Patent [19]

Widlar

[11] 4,249,122

[45] Feb. 3, 1981

[54] TEMPERATURE COMPENSATED BANDGAP IC VOLTAGE REFERENCES

[75] Inventor: Robert J. Widlar, Puerto Vallarta, Mexico

[73] Assignee: National Semiconductor Corporation, Santa Clara, Calif.

[21] Appl. No.: 928,631

[22] Filed: Jul. 27, 1978

[51] Int. Cl.[3] ..... G05F 3/20

[52] U.S. Cl. ..... 323/313; 330/297

[58] Field of Search ..... 307/296 R, 297; 330/296, 297; 323/1, 4, 8, 19, 22 T, 68

[56] References Cited

U.S. PATENT DOCUMENTS

| | | | |
|---|---|---|---|
| 3,617,859 | 11/1971 | Dobkin et al. | 323/19 X |
| 3,893,018 | 7/1975 | Marley | 323/19 |
| 3,908,162 | 9/1975 | Marley et al. | 323/19 |
| 4,088,941 | 5/1978 | Wheatley | 323/8 |
| 4,091,321 | 5/1978 | Hanna | 323/19 |
| 4,100,436 | 7/1978 | van de Plassche | 307/296 R |
| 4,103,219 | 7/1978 | Wheatley | 323/8 |

*Primary Examiner*—A. D. Pellinen

*Attorney, Agent, or Firm*—Gail W. Woodward; James A. Sheridan

[57] ABSTRACT

Bandgap voltage reference circuits have been developed for integrated circuit applications. Typically, a negative temperature coefficient first voltage is developed related to the base to emitter potential of a transistor. A positive temperature coefficient second voltage related to the difference in base to emitter potential between two transistors operating at different current densities is developed and combined with the first voltage so as to produce a temperature compensated reference voltage. Such first order compensation leaves second order effects uncompensated. In the invention, a third voltage having a suitable temperature coefficient is combined with the first and second voltages so that the resultant reference voltage is compensated to a second order.

8 Claims, 6 Drawing Figures

TEMPERATURE COMPENSATED BANDGAP IC VOLTAGE REFERENCES

BACKGROUND OF THE INVENTION

The invention relates to an improvement in temperature compensated voltage reference circuits. U.S. Pat. No. 3,617,859 issued to Robert C. Dobkin and Robert J. Widlar on a basic voltage reference circuit and is incorporated herein by reference.

An improved form of temperature compensated voltage reference circuit is disclosed in copending application Ser. No. 888,721 filed Mar. 21, 1978, by Robert C. Dobkin and titled AN IMPROVED BANDGAP VOLTAGE REFERENCE.

In the design of electronic circuits constant voltage references are often useful. The object is to develop a potential that has an absolute known magnitude that is substantially independent of current supply and load conditions. The avalanche or zener diode is characteristic of such a device but it has a temperature responsive voltage characteristic that is established by physical parameters. Furthermore, such devices have a knee, or transition region from variable to constant voltage, that produces noise. The so-called bandgap voltage reference devices have been developed in integrated circuit (IC) form in which the fundamental electronic properties of the semiconductor material are employed to develop a reference potential.

DESCRIPTION OF THE PRIOR ART

The prior art circuits are arranged to develop an output potential that is obtained by combining two potentials, one having a positive temperature coefficient and one having a negative temperature coefficient, in such a way that a temperature compensated output potential is produced.

The base to emitter voltage ($V_{BE}$) of a transistor is typically the source of potential with a negative temperature coefficient. The differential in base to emitter voltage ($\Delta V_{BE}$) of two transistors operating at different current densities is typically the source of potential with a positive temperature coefficient. When those potentials are combined to produce a potential equal to the semiconductor bandgap extrapolated to 0° K., the temperature dependent terms cancel for zero coefficient. Hence, the devices are often called bandgap references. Using silicon devices $V_{BE}$ at 300° K. is typically about 600 mV. With a current density ratio of abut ten, $\Delta V_{BE}$ is typically about 60 mV at 300° K. Since the extrapolated bandgap is about 1.205 volts, $\Delta V_{BE}$ is multiplied by ten and combined with $V_{BE}$ to produce 1.2 volts. It has been determined that if the reference is actually adjusted to 1.237 volts, the drift over the range of 220° to 400° K. is minimized, provided that the current in the $V_{BE}$ transistor varies directly with temperature. Thus, in the vicinity of 300° K. (close to normal room temperature) the reference voltage will not vary significantly with temperature.

In effect, as $V_{BE}$ falls at about 2mV for each degree K. rise in temperature, $\Delta V_{BE}$ will rise about 0.2 mV for each degree K. temperature rise. When $\Delta V_{BE}$ is multiplied by ten the rise compensates the fall.

The $\Delta V_{BE}$ potential is linearly related to temperature, as shown in patent 3,617,859. However, $V_{BE}$, while linear with respect to temperature to a first order, includes second order dependencies that make the temperature compensation imperfect, particularly over large temperature ranges.

In practice if a curve of potential versus temperature is plotted, it is quite flat in the vicinity of 300° K. but shows curvature at temperatures remote from 300° K. For example, even a good reference will display a change in excess of 0.5% over a ±80° K. range.

SUMMARY OF THE INVENTION

It is an object of the invention to improve the temperature compensation of bandgap voltage reference circuits.

It is a further object of the invention to reduce the curvature of the temperature-voltage characteristic in a bandgap voltage reference.

It is a still further object of the invention to produce a bandgap voltage reference in which second order temperature dependence is compensated.

These and other objects are achieved as follows. A bandgap voltage reference circuit is employed in the conventional manner. A $V_{BE}$ potential is generated and combined with a $\Delta V_{BE}$ related potential to produce a first order temperature-compensated reference potential. A third potential is developed, having a characteristic that matches the second order $V_{BE}$ temperature dependence, and combined with the first order terms to provide a reference potential, that is, compensates for the second order temperature dependence. In one embodiment the third potential is caused to vary with temperature by changing the current in a $V_{BE}$ transistor as a function of temperature raised to some power. The exponent is selected to be in the range of about 1.5 to 4, with 3 being preferred. In another embodiment the $\Delta V_{BE}$ potential is caused to vary by changing the ratio of current densities as a function of temperature.

DESCRIPTION OF THE INVENTION

In the following discussions transistor base current will be largely ignored. Since IC transistors can consistently be manufactured to have beta values of 200, the base current typically represents only about 0.5% of the collector current. Accordingly, the simplification will not introduce serious error. In those instances where base current cannot be ignored without introducing a serious error, it will be accounted for.

Figure 1:
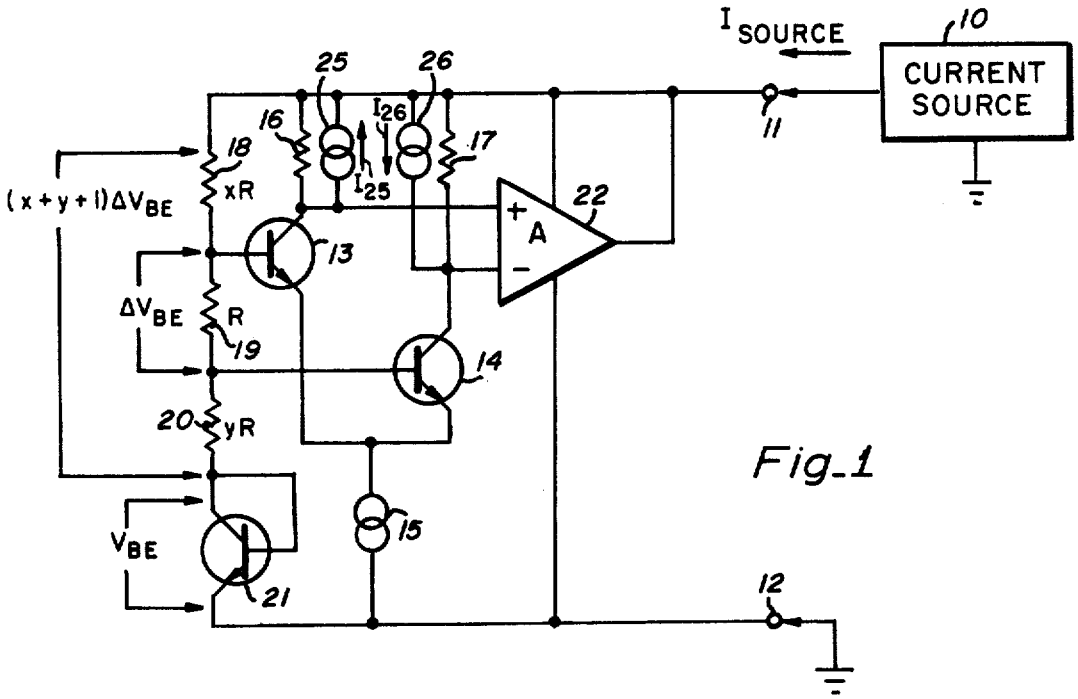
FIG. 1 is a schematic diagram showing a temperature compensated reference circuit with provision for compensating second order temperature dependency effects.

FIG. 1 shows a bandgap reference circuit of the kind disclosed in the above-referenced Dobkin application Ser. No. 888,721. A pair of terminals 11 and 12 define the circuit which is energized by current source 10 supplying $I_{source}$. Transistors 13 and 14 are differentially connected and current source 15 supplies their combined current. Transistors 13 and 14 are operated at different current densities to generate $\Delta V_{BE}$. Since transistor 14 is at the lower current density, its base will be of a lower potential than the base of transistor 13. Ratioing can be achieved by designing transistor 14 to have about ten times the area of transistor 13. In this case, load resistors 16 and 17 are matched so that equal currents will flow in the transistors. However, the current density ratio can be achieved by ratioing the load resistors 16 and 17 and using equal area transistors. Furthermore, the resistors can be ratioed as well as the transistor areas to achieve the desired current density ratio.

A voltage divider consisting of resistors 18–20 and diodeconnected transistor 21 in series is connected across terminals 11 and 12. Resistor 19 is coupled between the bases of transistors 13 and 14 to develop the $\Delta V_{BE}$ component. As shown in the drawing resistor 19 is R, resistor 18 is xR, and resistor 20 is yR. Thus if $\Delta V_{BE}$ appears across register 19, the combined resistor voltage drop will be $(x+y+1)\Delta V_{BE}$. If a current density ratio of ten is used, $\Delta V_{BE}$ will be about 60 mV at 300° K. If resistors 18 and 20 have a combined value of nine times the value of resistor 19, the three resistors will develop a potential of about 600 mV at 300° K. Since transistor 21 will develop a $V_{BE}$ of about 600 mV at 300° K., the total potential across the series combination is about 1.2 volts at 300° K. As pointed out above, the temperature coefficients of the two potentials will be substantially equal and opposite thus compensating the circuit for temperature to a first order.

The circuit is stabilized by amplifier 22 which senses the differential voltage at the collectors of transistors 13 and 14 and, by shunting a portion of $I_{source}$, forces the potential across terminals 11 and 12 to produce zero differential collector voltage.

In accordance with the invention, the temperature compensation of the circuit can be improved by accounting for second order effects. This can be done by inserting a temperature dependent imbalance into the circuit as shown by the current source at 25 or the current source at 26. By making $I_{25}$ in source 25 and/or $I_{26}$ in source 26 temperature dependent, as will be shown hereinafter, the circuit can be compensated for second order temperature effects as well as the first order compensated of the prior art. A key point is that $I_{25}$ and $I_{26}$ vary as a function of temperature in a different way than $I_{15}$.

The formula for $\Delta V_{BE}$ is:

$$\Delta V_{BE}=kT/q\ln(J1/J2) \quad (1)$$

Where:

q is the electron charge k is the Boltzmann's constant

T is absolute temperature

J1/J2 is the transistor current density ratio.

The formula for $V_{BE}$ is:

$$V_{BE}=V_{go}(1-T/T_o)+V_{BEo}(T/T_o)+nkT/q\ \ln(T_o/T)+kT/q\ln(I_C/I_{Co}) \quad (2)$$

Where:

$V_{go}$ is the semiconductor bandgap extrapolated to absolute zero.

$V_{BEo}$ is the base to emitter voltage at $T_o$ and $I_{Co}$ $I_C$ is collector current n is a transistor structure factor and is about 3 for NPN double-diffused IC transistors.

For the best compensation using silicon devices over a 220° K. to 400° K. temperature range:

$$1.237V=V_{BE}+\alpha\Delta V_{BE} \quad (3)$$

Where:

$\alpha$ is a multiplying factor.

Formula (1) shows that the $\Delta V_{BE}$ term is a linear function of temperature. However, $V_{BE}$ is not. The third term in Formula (2) is the one that causes the basic circuit of FIGS. 1 and 3 to depart from compensation and constitutes a significant second order effect. For small temperature changes $T_o/T\simeq 1$ and $\ln T_o/T$ is small and insignificant. However, over the temperature range demanded of operating devices, the logarithmic temperature ratio term becomes significant.

The current sources 25 and 26 of FIG. 1 will act to introduce an effective offset potential into the circuit and shift the current ratio in transistors 13 and 14 as a function of temperature. The feedback loop around amplifier 22 will still force the differential collector voltage to zero. This offset will then cause $\Delta V_{BE}$ to vary with temperature differently.

Figure 2:
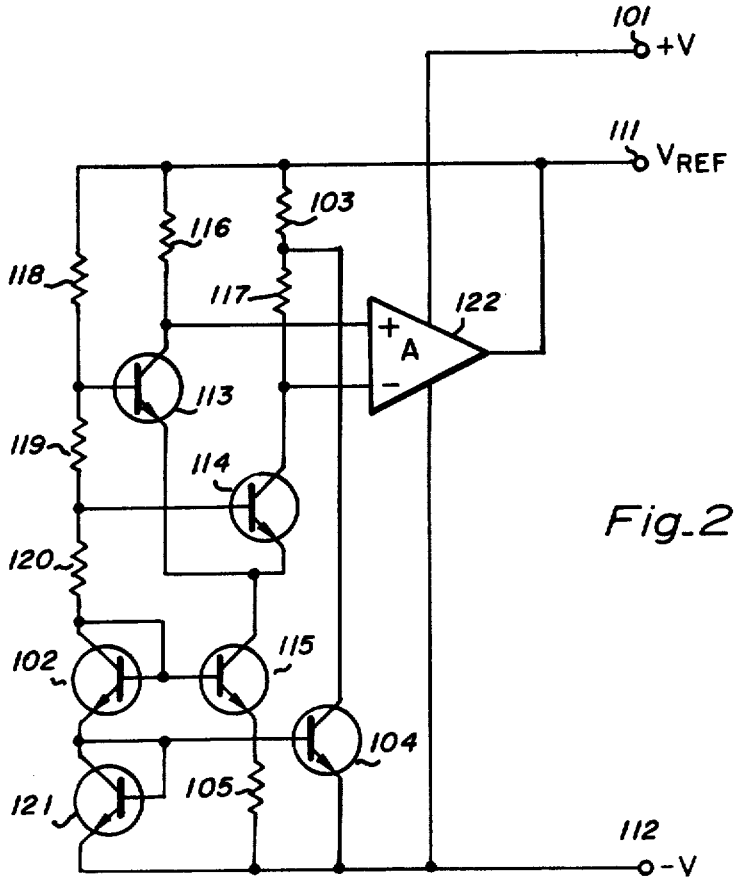
FIG. 2 is a schematic diagram of a practical implementation of the circuit of FIG. 1.

The circuit of FIG. 2 is a practical realization of the circuit of FIG. 1. In addition, it discloses a three-terminal circuit representation. It is to be understood that all of the circuits to be discussed herein can be implemented with a similar three-terminal equivalent.

A source of potential is applied between terminals 101 (+V) and 112 (−V). This would be the conventional voltage supplied to the IC. The reference potential shown at terminal 111 ($V_{REF}$) is in relation to terminal 112. A positive potential (+V) is applied to differential operational amplifier 122 as a power supply so that the output terminal, when coupled to terminal 111, will supply current thereto. Thus, the current source 10 of FIG. 1 is inherent in the circuit.

Transistors 113 and 114 are operated at ratioed current densities and $\Delta V_{BE}$ appears across resistor 119. Amplifier 122 drives the potential between terminals 111 and 112 to force the input differential to zero. Basically the circuit functions as was described for FIG. 1. However, it can be seen that the voltage divider that includes resistors 118, 119, and 120 also includes two diode connected transistors, 102 and 121. Since resistor 119 develops about 60 mV at 300° K., resistors 118 and 120 should develop a total of about 1.24 volts to provide a $V_{REF}$ of about 2.5 volts, for basic compensation.

Transistor 104 is connected to diode 121 to provide a current inverter. Thus the current flowing in resistor 103 mirrors the current flowing in resistor 119 which is proportional to $\Delta V_{BE}$. Resistor 103 has a relatively small value so that it develops a few tens of millivolts at 300° K. and this voltage has a positive temperature coefficient. This voltage appears in series with resistor 117 and constitutes an offset potential at the input to amplifier 122. The amplifier will still act on the voltage at terminal 111 to force its differential input to zero.

Transistor 115 acts as a current source to transistors 113 and 114. Since the base of transistor 115 is biased up two $V_{BE}$ values, the voltage across resistor 105 will be equal to one $V_{BE}$. Thus resistor 105 sets the combined current flowing in transistors 113 and 114 and this current has a negative temperature coefficient because it is directly proportional to $V_{BE}$.

As temperature rises, the total current in transistors 113 and 114 will fall and the potential across resistor 103 will rise. These values can be proportioned so that the curvature of the temperature voltage curve of the uncompensated circuit is largely cancelled and the circuit is temperature compensated to a second order.

Figure 3:
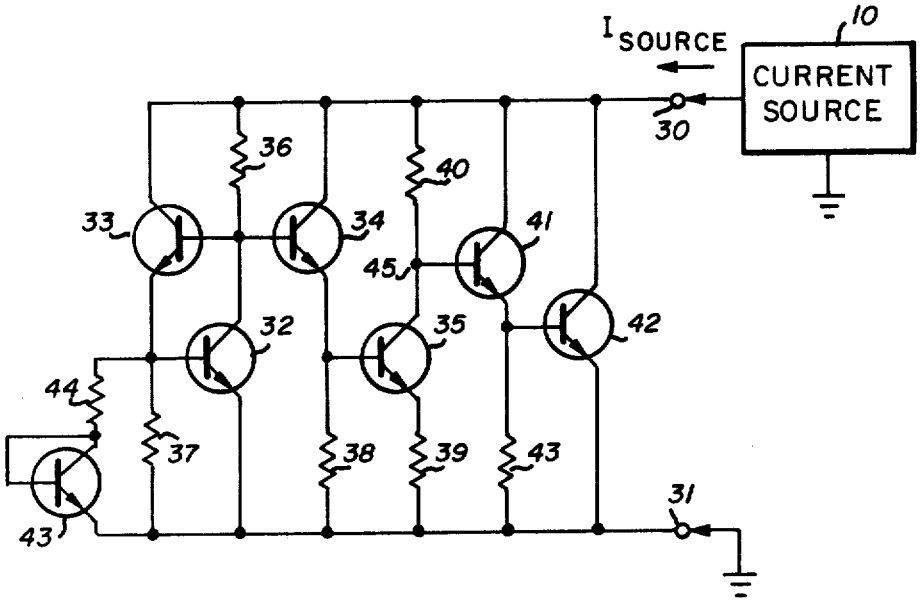
FIG. 3 is a schematic diagram of a basic reference circuit with second order temperature compensation.

FIG. 3 shows a bandgap reference designed to work at twice the semiconductor bandgap voltage when energized by current source 10. The basic operation is similar to the circuit disclosed in U.S. Pat. No. 3,617,859.

The $\Delta V_{BE}$ term is generated by transistors 32 thru 35 and appears across resistor 39. The actual value of $\Delta V_{BE}$ will be:

$$\Delta V_{BE} = V_{BE\,32} + V_{BE\,33} - V_{BE\,34} - V_{BE\,35} \quad (4)$$

where the number subscripts denote the transistor. The current through transistor 32 is established by resistor 36, the current through transistor 33 by resistors 37 and 44, the current through transistor 34 by resistor 38, and the current through transistor 35 by resistor 39. Thus, each transistor can have its current independently set. The $\Delta V_{BE}$ of formula (4) will appear across resistor 39. If resistor 40 is ratioed with respect to resistor 39, it will develop a multiple of $\Delta V_{BE}$ equal to the ratio. In operation, the $V_{BE}$ values of transistors 41 and 42 will combine with the $\Delta V_{BE}$ multiple across resistor 40 to provide a bandgap reference of about 2.5 volts across terminals 30–31.

Transistors 41 and 42 are connected into a Darlington configuration along with resistor 43 Node 45 will be $V_{BE\,41} + V_{BE\,42}$ above terminal 31 and at 300° K. will develop about 1.25 volts. This combined with the $\Delta V_{BE}$ related drop across resistor 40 will provide the temperature compensated 2.5 volts between terminals 30 and 31.

As explained above, the compensation is to a first order and the temperature versus voltage characteristic is curved. Transistor 43 and resistor 44 are added to the circuit to provide the desired second order compensation. As temperature rises, the $V_{BE}$ across transistors 43 and 32 falls with the $V_{BE}$ of 43 falling more rapidly since it operates at lower current density. This action increases the relative current in transistor 33. Thus, while $\Delta V_{BE}$ varies normally with temperature, an additional or compensating variation is introduced to provide a second order temperature compensation.

Figure 4:
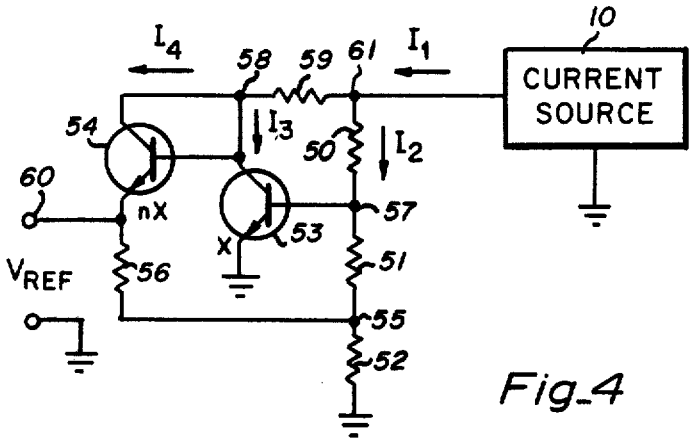
FIG. 4 is a schematic diagram of a very low voltage reference having second order temperature compensation.

FIG. 4 shows a very low voltage reference circuit that is compensated for second order temperature effects. In the circuit of FIG. 4 operation is from current source 10 supplying $I_1$. A portion of $I_1$, labeled $I_2$, will flow through the voltage divider consisting of resistors 50–52. Another portion, $I_3$, flows through transistor 53 and the remainder, $I_4$ flows through transistor 54 and back to node 55 by way of resistor 56.

Transistor 54 is manufactured to have an emitter area large with respect to the emitter area of transistor 53 and the current in transistor 54 is made small with respect to the current in transistor 53. Thus, the current density in transistor 54 is much smaller than the current density in transistor 53.

The circuit functions to develop a reference potential ($V_{REF}$) at terminal 60 and is arranged to maintain this potential constant as a function of temperature.

The $V_{BE}$ potential of transistor 53 appears at node 57. The voltage divider action of resistors 50–52 results in a fraction of this $V_{BE}$ to appear across resistor 50. Thus, at node 61 a potential of $V_{BE}$ plus a fraction thereof appears. Assuming resistor 59 to be zero for the moment, it can be seen that, with respect to terminal 60, the $V_{BE}$ of transistor 54 will subtract from the potential at node 61 so that $V_{REF}$ will contain a $\Delta V_{BE}$ term. This term will be:

$$\Delta V_{BE} = kT/q \ln(J_{53}/J_{54}) \quad (5)$$

Where:

k is Boltzman's constant

T is absolute temperature q is electron charge $J_{53}$ is current density in transistor 53

$J_{54}$ is current density in transistor 54

If the current density ratio is set, for example, at 50, $\Delta V_{BE}$ at 300° kelvin will be about 100 mV. If the fraction of $V_{BE}$ appearing across resistor 50 is made about 100 mV at 300 ° kelvin, $V_{REF}$ will be about 200 mV. Accordingly, $V_{REF}$ is:

$$V_{REF} = \Delta V_{BE} + (V_{BE\,53})/6 \quad (6)$$

The first term has a positive temperature coefficient and the second term has an equal negative temperature coefficient so that, to a first order, temperature compensation is achieved.

Resistor 59 is present in the circuit to permit correction for current source variations. A portion of $I_1$ will flow into the base of transistor 53 which will act as an inverting amplifier to node 58. Thus, if resistor 59 is made equal to the reciprocal of the transconductance of transistor 53, node 58 will be compensated for variations in $I_1$.

As shown above, the circuit is compensated for first order temperature effects. By returning resistor 56 to a tap, node 55, on the resistance associated with the $V_{BE}$ of transistor 53, a second order temperature compensation is achieved.

Resistor 56 will determine the current flowing in transistor 54 and hence its current density, $J_{54}$ of equation (5). Since the potential at node 55 will fall within rising temperature, due to the $V_{BE}$ of transistor 53, the current flowing in transistor 54 and hence its current density will increase with a rising temperature but less rapidly than the current in 53. Thus, the $\Delta V_{BE}$ term is varied non linearly as a function of temperature in such a direction as to compensate for the curvature in $V_{BE}$ (and that introduced by the temperature drift of diffused resistors). The degree of compensation can be adjusted by the ratio of resistors 51 and 52, to compensate the curvature of the first order compensation described above.

Figure 5:
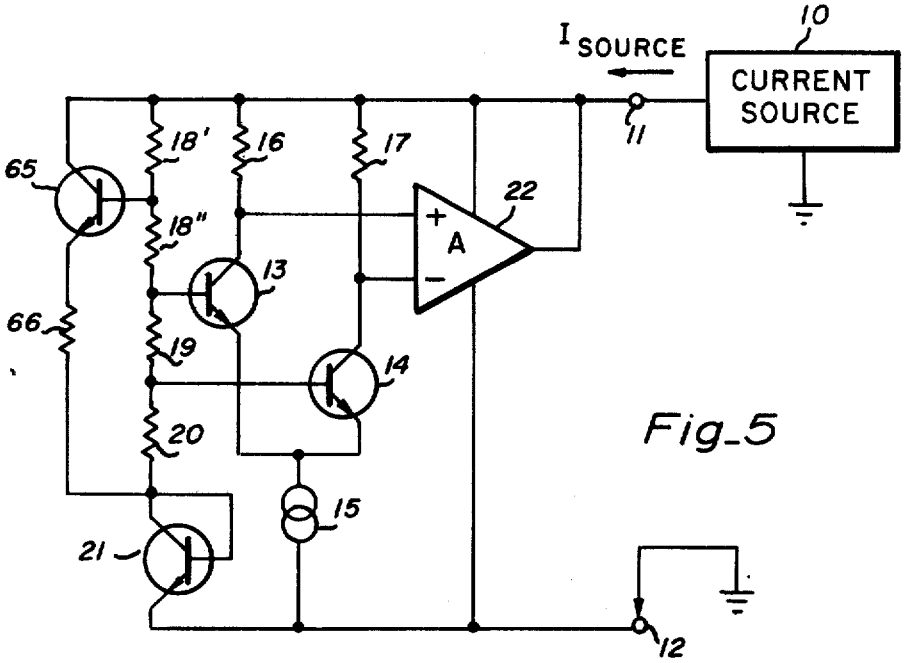
FIG. 5 is a schematic diagram of the reference of FIG. 1 with discontinuous second order temperature compensation.

FIG. 5 represents an alternative compensation method for the circuit of FIG. 1. However, the compensation in FIG. 5 is discontinuous. All of the part designations are as used in FIG. 1 and the first order compensation is as was described for FIG. 1.

The second order compensation is achieved by the action of transistor 65 and resistor 66. At the design temperature, for example, 300° K. where $\Delta V_{BE}$ would be set to 60 mV which appears across resistor 19, transistor 65 is inoperative. That is, the potential developed across resistors 18'', 19, and 20 is less than one $V_{BE}$ so that negligible current will flow in resistor 66. As temperature rises and $\Delta V_{BE}$ increases, and $V_{BE}$ decreases, a point will be reached where transistor 65 will be turned on. As temperature further increases the current in transistor 65 will increase. Resistor 66 will determine how much the current in transistor 65 will rise and the tap on resistor 18 which sets the relative values of resistors 18' and 18'' will determine the temperature at which transistor 65 will turn on. This is selected to be the temperature at which curvature exceeds a certain value in the basic circuit. The increasing current flow in transistor 21 will cause its $V_{BE}$ value to increase. This will offset the normal tendency of $V_{BE}$ to decline excessively with temperature. The degree of compensation at the higher temperatures will be established by the value of resistor 66.

Figure 6:
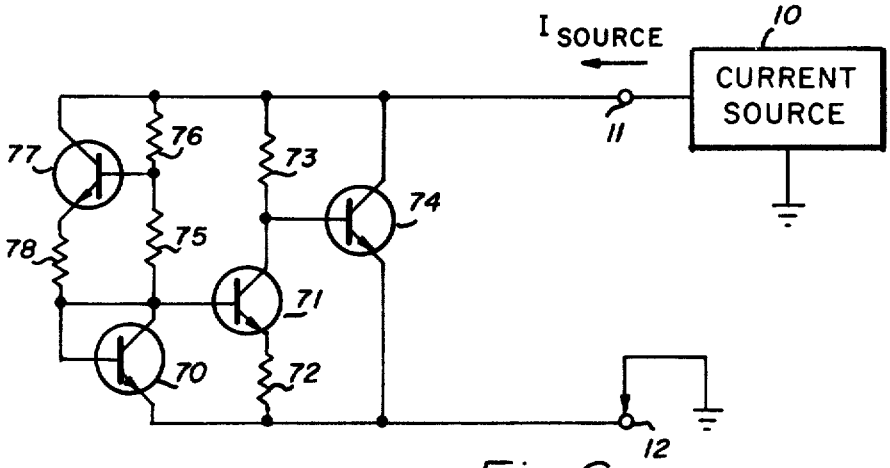
FIG. 6 is a schematic diagram of a basic reference circuit with discontinuous temperature compensation.

FIG. 6 represents a discontinuously compensated bandgap reference of the kind disclosed in U.S. Pat. No. 3,617,859. Source 10 supplies $I_{source}$ to terminals 11 and 12. Transistors 70 and 71 generate $\Delta V_{BE}$ which appears across resistor 72. Assuming a ten to one current density ratio, $\Delta V_{BE}$ will be about 60 mV at 300° K. If resistor 72 is made 600 ohms, 100 microamperes will flow in transistor 71 at 300° K. If resistor 73 is made ten times the value of resistor 72, it will develop a drop of about 0.6 volt, proportional to $V_{BE}$. Since this drop is combined with the $V_{BE}$ of transistor 74, a compensated 1.2 volts appears across terminals 11 and 12. Clearly the required current density ratio can be established by current ratioing, area ratioing, or the combination of current and area ratioing.

The circuit described thus far is temperature compensated to a first order. Transistor 77 and resistor 78 provide the second order compensation. Since the base is tapped into the divider consisting of resistors 75 and 76, less than a $V_{BE}$ at 300° K. will be applied to the emitter-base circuit of transistor 77. It will therefore be nonconductive. As temperature rises the $V_{BE}$ in transistor 70 will drop thereby increasing the potential across resistor 75. At some temperature, as determined by the values of resistors 75 and 76, transistor 77 will turn on and act to shunt resistor 75 thereby tending to increase the $V_{BE}$ of transistor 70 and offset its tendency to fall excessively with rising temperature. The amount of compensation is established by the value of resistor 78. This provides a discontinuous compensation of the second order temperature effect

EXAMPLE I

The circuit of FIG. 4 was constructed using standard bipolar IC techniques. The transistors had a Beta of about 200. The following resistor values were established using ion implanted resistors;

| Resistor | Value/ohms |
|---|---|
| 50 | 14.8K |
| 51 | 82.4K |
| 52 | 2.5K |
| 56 | 135K |
| 59 | 2.8K |

The circuit was operated at about 20 microamperes. The reference voltage drift was less than 0.1% over the range of 220° K. to 400° K.

EXAMPLE II

The circuit of FIG. 2 was constructed as described in EXAMPLE I. All transistors were designed to have the same emitter area. The following resistor values were used:

| Resistor | Value/ohms |
|---|---|
| 103 | 400 |
| 105 | 6K |
| 116 | 3K |
| 117 | 30K |
| 118 | 6.2K |
| 119 | 600 |
| 120 | 6.2K |

Amplifier 122 was a conventional high gain differential operational amplifier trimmed to have substantially zero offset voltage.

$V_{REF}$ was 2.44 volts and varied less than 0.5 mv. over a temperature range of −55° to +100° C.

The invention has been described and examples of its implementation set forth. A person skilled in the art when reading the foregoing disclosure will appreciate that there are other obvious alternatives and equivalents that come within the intent of the invention. Accordingly, it is intended that the scope of the invention be limited only by the following claims.

We claim:

1. In a voltage reference circuit comprising:

means for supplying operating current to said circuit;

means for developing a first potential based upon the base to emitter potential of a transistor, said first potential having a negative temperature coefficient;

means for developing a second potential based upon the difference in the base to emitter potentials of first and second transistors operating at different current densities to produce a current density ratio, said second potential having a positive temperature coefficient; and means for combining said first and second potentials to obtain a reference potential, said means for combining operating to produce a reference potential that is temperature compensated to a first order; the improvement comprising:

means for varying said current density ratio as a function of temperature to temperature compensate said reference potential to a second order.

2. The circuit of claim 1 wherein said means for varying said current density ratio comprise means responsive to said first potential and coupled to at least one of said first and second transistors thereby to vary the current in said one transistor relative to the current in the other transistor.

3. The circuit of claim 2 wherein said current density ratio is increased with increasing temperature.

4. The circuit of claim 3 further comprising means responsive to a potential having a negative temperature coefficient and operative to vary the currents in both of said first and second transistors.

5. The circuit of claim 3 wherein said means for varying said current density is only operative above a predetermined temperature.

6. A voltage reference circuit comprising:

a pair of terminals across which a reference potential can be developed in response to the passage of an operating current;

means coupled to said terminals for developing a first potential having a positive temperature coefficient, said first potential being developed in proportion to the difference in base to emitter potentials produced in a pair of transistors operating at different current densities to establish a current density ratio;

means coupled to said terminals for developing a second potential having a negative temperature coefficient, said second potential being developed in proportion to the base emitter potential of a current conducting transistor;

means for combining said first and second potentials so that said positive and negative temperature coefficients cancel to produce a potential available at said terminals that is temperature compensated to a first order; and means for varying said current density ratio as a function of temperature to provide second order temperature compensation of said reference potential.

7. The circuit of claim 6 wherein said means for varying is operativeabove a critical temperature and constitutes a discontinuous second order temperature compensation.

8. The circuit of claim 7 wherein said means for varying includes a transistor biased in response to a fraction of said first potential, said fraction being selected to render said transistor conductive at temperatures in excess of a predetermined value.

* * * * *